United States Patent [19]

Mishcon, deceased et al.

[11] 4,141,227

[45] Feb. 27, 1979

[54] PLATE ASSEMBLY FOR A CIRCULAR KNITTING MACHINE

[75] Inventors: Lester Mishcon, deceased, late of Miami Beach, Fla., by Martha Mishcon, executrix; Harry Agulnek, Miami Beach, Fla.

[73] Assignee: Vanguard Supreme Machine Corporation, Monroe, N.C.

[21] Appl. No.: 833,196

[22] Filed: Sep. 14, 1977

[51] Int. Cl.[2] ..... D04B 15/53; D04B 15/76

[52] U.S. Cl. ..... 66/229; 66/138

[58] Field of Search ..... 66/50 R, 50 A, 138, 66/140 R

[56] References Cited

U.S. PATENT DOCUMENTS

| | | | |
|---|---|---|---|
| 1,925,450 | 9/1933 | Levin | 66/50 A |
| 2,539,790 | 1/1951 | Mishcon et al. | 66/50 A |
| 3,310,965 | 3/1967 | Mahler | 66/50 B X |
| 3,823,579 | 7/1974 | Schindele et al. | 66/50 R |
| 4,024,733 | 5/1977 | Mishcon et al. | 66/50 A |
| 4,033,150 | 7/1977 | Mishcon et al. | 66/138 |

FOREIGN PATENT DOCUMENTS

| | | | |
|---|---|---|---|
| 660630 | 2/1929 | France | 66/50 R |
| 21523 | 9/1913 | United Kingdom | 66/50 A |

*Primary Examiner*—Wm. Carter Reynolds

*Attorney, Agent, or Firm*—Bell, Seltzer, Park & Gibson

[57] ABSTRACT

A cam section block, a striping box actuator assembly, and a positioning device for a wheel nullifying cam are all secured to a plate mounted on the cam retaining ring of a circular knitting machine. A plunger of the striping box assembly and a plunger of the cam positioning device are operable by camming under the cam retaining ring, and the plate is readily removable from the machine with all components attached.

3 Claims, 2 Drawing Figures

PLATE ASSEMBLY FOR A CIRCULAR KNITTING MACHINE

BACKGROUND OF THE INVENTION

1. Field of the Invention

The invention relates to circular knitting machines and especially to circular knitting machines adapted to knit striped fabric.

2. Description of the Prior Art

Circular knitting machines adapted for producing striped fabric such as the machines shown and described in U.S. Pat. Nos. 2,539,798 and 2,543,121, generally include striping boxes equipped with a plurality of yarn feeding fingers for selectively feeding variously colored yarns to needles at yarn feeding stations around the machine. The striping boxes are operated by the plungers of actuating assemblies, and in high production machines, with many cam feeding stations such that there is little space at each station, the actuator assemblies are necessarily so situated with respect to the cam section blocks, that the cam section blocks can not be readily removed from the machine to permit access to the needle actuating cams, unless the actuator assemblies are first removed. In such machines wherein automatically operable wheel nullifying cams are utilized, positioning devices for those cams also interfere with removal of the cam section blocks unless first detached from the machine.

SUMMARY OF THE INVENTION

In accordance with the invention, a cam section block, a cam positioning device and a striping box actuator assembly are supported on a plate for use at each of various yarn feeding stations of a circular knitting machine which is to produce striped fabric. The plate is secured to the cam retaining ring of the machine, and the striping box actuator assembly and cam positioning device are associated with control camming under the ring in a manner permitting the striping box plunger and cam actuating device to be actuated through the plate, yet also permitting the plate to be easily removed from the machine with the actuator assembly and cam positioning device attached.

DESCRIPTION OF THE PREFERRED EMBODIMENT OF THE INVENTION

Figure 1:
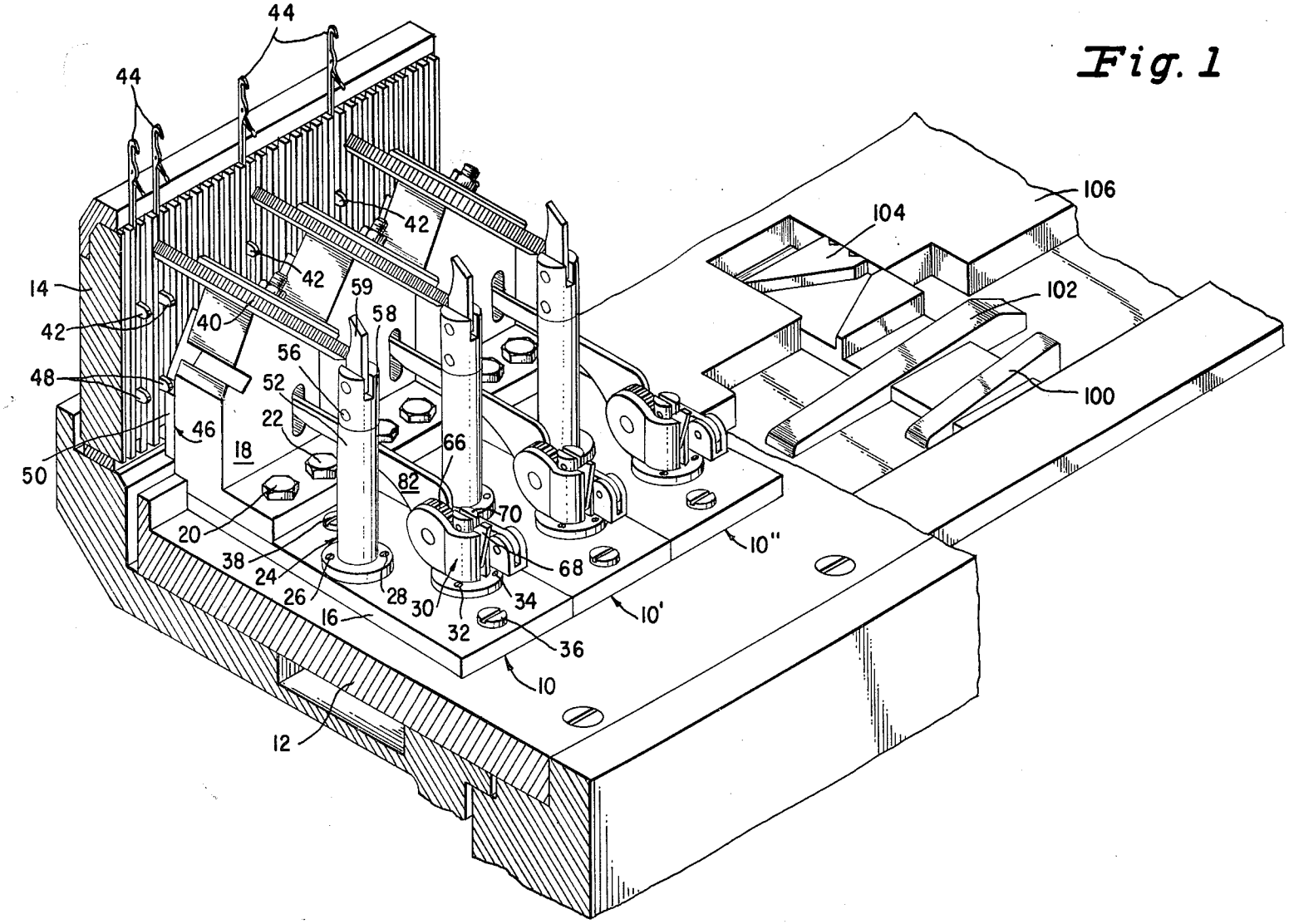
FIG. 1 is a somewhat diagrammatic perspective view showing a portion of a circular knitting machine with plate assemblies according to the invention.

Referring to the drawings, reference character 10 designates one of a plurality of plate assemblies according to the invention for a circular knitting machine of the type shown and described in U.S. Pat. No. 2,539,790. Such plate assemblies fasten to a cam retaining ring 12 where they extend side by side around the needle cylinder 14 of the machine in the manner indicated in FIG. 1, for the plate assemblies 10, 10' and 10''. The plate assemblies all being alike only plate assembly 10 is described herein in detail.

Plate assembly 10 includes a base plate 16, a cam section block 18 secured by bolts 20 and 22 to the base plate, an actuator assembly 24 secured to the base plate by screws 26 and 28, and a cam positioning device 30 secured to plate 16 by screws 32 and 34. The base plate 16 is affixed to ring 12 by two screws 36 and 38.

Figure 2:
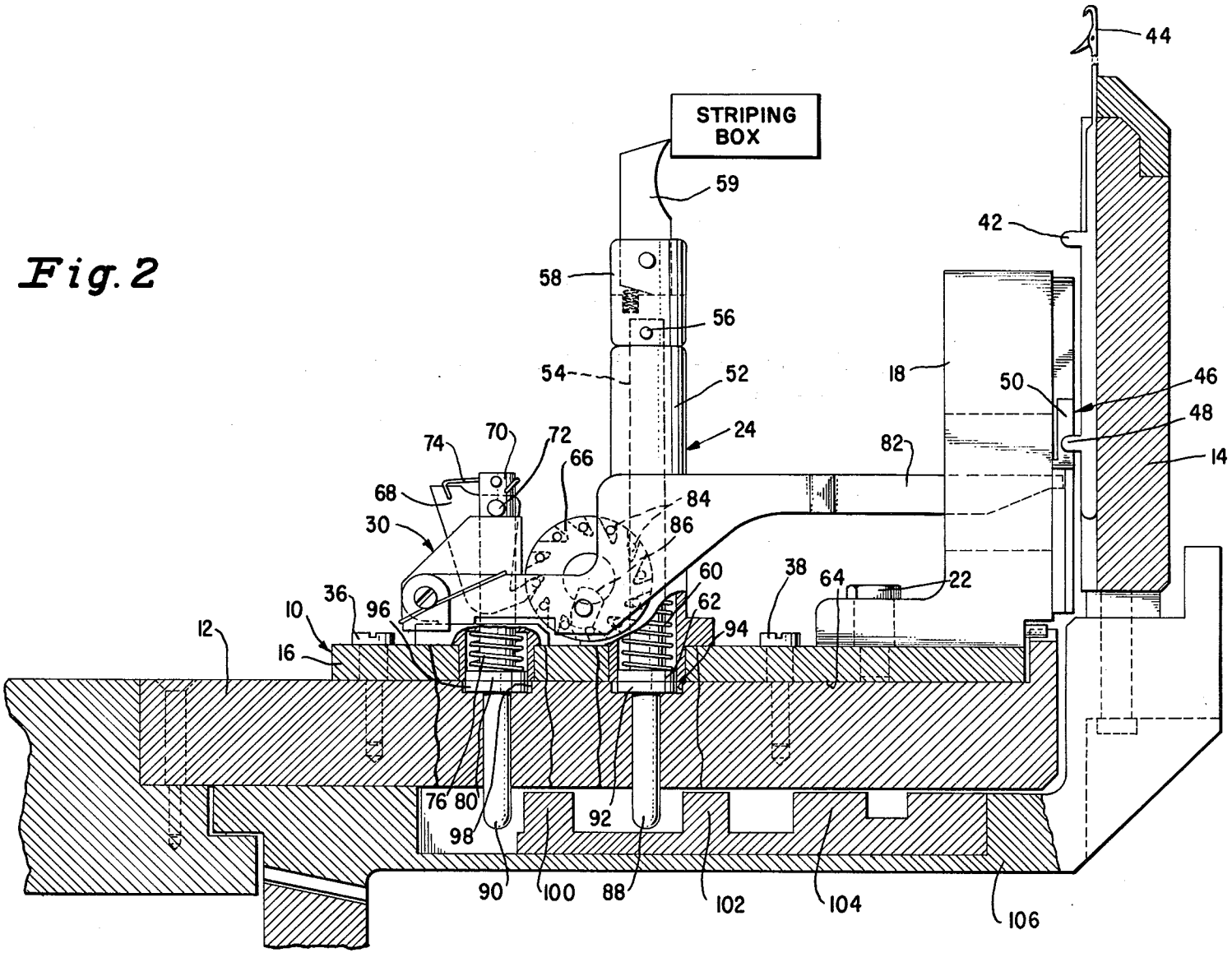
FIG. 2 is a vertical sectional view taken through the plate assembly of the invention and showing the actuating plungers of components thereon.

As shown, cam section block 18 supports a rotatable pattern wheel 40 engageable with the butts 42 of needles 44. The section block also supports camming 46 engageable with the butts 48 of the needles 44. Camming 46, includes an adjustable cam 50 (wheel nullifying cam) which can be moved between an inactive position and a position to raise needles to "knit" (see FIG. 2). The cam section block 18 including the pattern wheel and needle actuating cams may, for example, be of the type shown and described in U.S. Pat. No. Re. 28,519.

Actuator assembly 24 is of the kind shown, for example, in U.S. Pat. No. 2,543,121, and as such, includes a cylindrical housing 52 and a plunger 54 slidable therein. The plunger is affixed at 56 to a member 58 which supports a pivotally mounted pawl 59 and serves as a stop limiting downward movement of the plunger in response to the biasing force of a spring 60. When member 58 is against housing 52, a flanged lower end 62 of the plunger is even with the bottom 64 of plate 16. Pawl 59 actuates a striping box (not shown) as in the aforementioned U.S. Pat. No. 2,539,790, when plunger 54 is moved upwardly as hereinafter described against the bias of spring 60.

Cam positioning device 30 is of the kind shown in the aforementioned U.S. Pat. No. 2,539,790. The device includes a rotatable toothed ratchet wheel 66 associated with a pawl 68 which is pivotally attached to a plunger 70 on a pin 72 and is biased by a spring 76 into engagement with the ratchet wheel. The plunger is biased downwardly by a spring 76 into a position wherein pin 72 engages the housing of the device and the lower end 80 of the plunger is even with the bottom of plate 16. The device includes a finger 82 and horizontally positionable pins 84 on the wheel selectively engageable according to their position with a cam 86 on the finger. Plunger 70 is movable upwardly by camming hereinafter described and when so moved indexes wheel 66. A pin 84 may then, if suitably positioned, engage cam 86 and thereby cause finger 82 to move wheel nullifying cam 50 on section block 18 into a "knit" position.

In accordance with the invention, pins 88 and 90 are mounted for vertical upward movement in cam retaining ring 12 directly under plungers 54 and 70 respectively. Pin 88 includes a flanged head or enlarged flange 92 which normally rests in a recess 94 in ring 12 and pin 90 includes flanged head 96 which normally rests in a recess 98 in the ring 12. The pins 88 and 90 are actuable by floating cams such as shown and described in the aforesaid U.S. Pat. No. 2,539,790, that is, by cams 100 and 102. Such cams are located on a block 104 which is radially slidable in a rotating cylinder ring 106 between an actuating and nonactuating position for the cams. Suitable means for controlling the radial position of block 104 are shown and described in the said U.S. Pat. No. 2,539,790.

When pins 88 and 90 are engaged by the cams 100 and 102, they move upwardly from their normal positions. Pin 88 raises plunger 54 to index a striping box and pin 90 raises plunger 70 to index cam positioning device 30. After having been raised, the pins return to their rest positions in recesses 94 and 98 and the plungers return to their unactuated positions.

Since the bottom ends of the plungers 54 and 70 are even with the bottom of plate 16 in their unactuated positions and do not protrude into cam ring 12, and since the upper plunger engageable flat surfaces of the flanged heads 92, 96 of pins 88 and 90 are normally flush with the top or upper surface of ring 12, in the unactuated positions of the pins 88, 90, it is a simple matter to remove the plate assembly 10 with the cam section block 18, actuator assembly 24 and cam positioning device 30 thereon. An operator who wishes to check and perhaps replace needle actuating cam need not remove the plunger assembly 24, the cam positioning device and finally the cam section block 18 to gain access to the cams. He need only remove the two screws 36 and 38, and remove the plate assembly as a unit.

Although the invention has been described in its preferred form, with a certain degree of particularity, it is to be understood that the present disclosure of the preferred form has been made by way of example only and that changes in the details of construction and the arrangement of parts may be resorted to without departing from the spirit and scope of the invention.

Having thus set forth the nature of the invention, what is claimed herein is:

1. In a circular knitting machine, an actuator assembly for a striping box including a movable plunger; a cam section block including an adjustable needle actuating cam; a device for positioning said adjustable needle actuating cam, said positioning device including a plunger for initiating operation thereof; a plate having said actuator assembly for said striping box, said cam section block, and said cam positioning device mounted thereon; a ring to which said plate is secured; control camming under said ring; a pin actuable by said control camming, said pin including an enlarged flange with a plunger engageable flat upper surface adapted to engage and move said plunger of said striping box actuator assembly; another pin actuable by said control camming, said another pin including an enlarged flange with a plunger engageable flat upper surface adapted to engage and move said plunger of said cam positioning device; and said ring including recesses for receiving said enlarged flanges of said pins so that the plunger engageable flat upper surfaces thereof are flush with the upper surface of said ring in the unactuated positions of said pins.

2. In a circular knitting machine, an actuator assembly for a striping box including a movable plunger, a cam section block with needle controlling cams thereon, a plate having said cam section block and said plunger mounted thereon, a ring to which said plate is secured, control camming under the ring, a pin actuable by said control camming, said pin including an enlarged flange with a plunger engageable flat upper surface adapted to engage and move said plunger, and said ring including a recess for receiving said enlarged flange of said pin so that the plunger engageable flat upper surface of said enlarged flange is flush with the upper surface of said ring in the unactuated position of said pin.

3. In a circular knitting machine, a cam section block including an adjustable cam for controlling the movement of needles in the machine; a device for positioning said adjustable cam, said positioning device including a plunger for initiating operation thereof; a plate having said cam section block and said positioning device mounted thereon; a ring to which said plate is secured; control camming under said ring; a pin actuable by said control camming, said pin including an enlarged flange with a plunger engageable flat upper surface adapted to engage and move said plunger, and said ring including a recess for receiving said enlarged flange of said pin so that the plunger engageable flat upper surface of said enlarged flange is flush with the upper surface of said ring in the unactuated position of the pin.

* * * * *